US009726056B2

(12) United States Patent
Resh et al.

(10) Patent No.: US 9,726,056 B2
(45) Date of Patent: Aug. 8, 2017

(54) HIGH EFFICIENCY OIL CIRCUIT

(75) Inventors: William F. Resh, East Lansing, MI (US); Wei Tao, Troy, MI (US); Bruce Geist, Sterling Heights, MI (US)

(73) Assignee: FCA US LLC, Auburn Hills, MI (US)

( * ) Notice: Subject to any disclaimer, the term of this patent is extended or adjusted under 35 U.S.C. 154(b) by 870 days.

(21) Appl. No.: 13/476,125

(22) Filed: May 21, 2012

(65) Prior Publication Data

US 2013/0306022 A1 Nov. 21, 2013

(51) Int. Cl.

*F04B 49/00* (2006.01)
*F01M 1/02* (2006.01)
*F01M 1/12* (2006.01)

(52) U.S. Cl.

CPC ..... *F01M 1/02* (2013.01); *F01M 1/12* (2013.01); *F01M 2001/123* (2013.01)

(58) Field of Classification Search

CPC ..... F01M 1/02; F01M 2001/123; F01M 2011/0037; F01M 1/04; F01M 2001/0261; F01M 2001/0269; F01M 2011/026; F16C 33/6659

USPC ..... 123/41.35, 196 R

See application file for complete search history.

(56) References Cited

U.S. PATENT DOCUMENTS 3,045,420 A 7/1962 Addie et al.
5,195,474 A * 3/1993 Urata et al. ..... 123/90.12
6,055,851 A * 5/2000 Tanaka et al. ..... 73/46
7,272,928 B2 * 9/2007 Ariga et al. ..... 60/428
7,290,991 B2 * 11/2007 Staley et al. ..... 417/286
7,401,465 B2 * 7/2008 Emmert et al. ..... 60/430
7,546,821 B2 * 6/2009 Russell et al. ..... 123/90.12
7,748,353 B2 * 7/2010 Russell et al. ..... 123/90.12
2002/0001526 A1 * 1/2002 Howard ..... 417/286
2004/0074732 A1 * 4/2004 Busold et al. ..... 192/87.13
2006/0207248 A1 * 9/2006 Ariga et al. ..... 60/452
2009/0000592 A1 * 1/2009 Luft et al. ..... 123/196 R
2009/0217656 A1 * 9/2009 Yoshimoto et al. ..... 60/456
2009/0232673 A1 * 9/2009 Reisch et al. ..... 417/364

(Continued)

FOREIGN PATENT DOCUMENTS

DE 2620480 A1 11/1977
DE 19926350 C1 11/2000

(Continued)

OTHER PUBLICATIONS

Written Opinion & International Search Report for PCT/US13/041154, mailed Sep. 17, 2013, 10 pages.

*Primary Examiner* — Marguerite McMahon
*Assistant Examiner* — Tea Holbrook
(74) *Attorney, Agent, or Firm* — Ralph E. Smith

(57) ABSTRACT

In at least one implementation, an engine oil circuit for a vehicle includes first and second oil circuits, and first and second oil pumps. The first oil circuit is communicated with at least one first engine component and the first oil pump is communicated with the first oil circuit to supply fluid flow in the first oil circuit at a first flow rate and a first pressure. The second oil circuit is communicated with at least one second engine component and may be segregated from the first oil circuit. The second oil pump is communicated with the second oil circuit to supply fluid flow in the second oil circuit at a second flow rate and a second pressure. At least one of the second flow rate or the second pressure is different than the first flow rate or the first pressure.

15 Claims, 3 Drawing Sheets

(56) References Cited

U.S. PATENT DOCUMENTS

| | | | | |
|---|---|---|---|---|
| 2010/0072019 | A1* | 3/2010 | Ogasawara | 192/48.611 |
| 2010/0287924 | A1* | 11/2010 | Dostal et al. | 60/430 |
| 2010/0294231 | A1* | 11/2010 | Kusel | 123/196 R |
| 2011/0192156 | A1* | 8/2011 | Sato et al. | 60/431 |
| 2011/0209682 | A1* | 9/2011 | Storch et al. | 123/196 R |
| 2012/0060488 | A1* | 3/2012 | Grethel et al. | 60/484 |
| 2012/0070318 | A1* | 3/2012 | Kai et al. | 417/286 |

FOREIGN PATENT DOCUMENTS

| | | | | |
|---|---|---|---|---|
| DE | 10322304 | * | 12/2004 | |
| DE | 10322304 | A1 | 12/2004 | |
| EP | 503635 | A1 * | 9/1992 | F01M 1/02 |
| EP | 0775813 | A1 | 5/1997 | |
| FR | 2909410 | A1 | 6/2008 | |
| JP | 2006161853 | A * | 6/2006 | |

* cited by examiner

HIGH EFFICIENCY OIL CIRCUIT

FIELD

The present disclosure relates to an oil supply circuit in a vehicle and more particularly to a segregated oil supply circuit for a vehicle engine.

BACKGROUND

Automotive vehicles include an array of engine components that are fed a supply of engine oil for lubrication. Such components include bearings, cam phasers, chain oilers, chain tensioners, as well as other hydraulic components. A single oil pump and single oil circuit are used to provide oil to all such components. Accordingly, the oil pressure and flow rate within the circuit are maintained at levels suitable to meet or exceed the minimum requirements of the component or components that require the highest flow rate and the highest pressure.

SUMMARY

In at least one implementation, a segregated engine oil circuit for a vehicle includes first and second oil circuits, and first and second oil pumps. The first oil circuit is communicated with at least one first engine component and the first oil pump is communicated with the first oil circuit to supply fluid flow in the first oil circuit at a first flow rate and a first pressure. The second oil circuit is communicated with at least one second engine component and may be segregated from the first oil circuit. The second oil pump is communicated with the second oil circuit to supply fluid flow in the second oil circuit at a second flow rate and a second pressure. At least one of the second flow rate or the second pressure is different than the first flow rate or the first pressure.

Additionally, two or more oil circuits may be provided in an engine oil delivery system for a vehicle. For example, at least two oil circuits may be provided with each oil circuit separately communicated with at least one engine component that is not communicated with any other oil circuit. At least two oil pumps are provided with at least one oil pump provided for each oil circuit and where at least one of said oil pumps provides oil to its respective engine component at a flow rate or pressure that is different than at least one other oil pump. This may provide a different hydraulic power within one or more of the fluid circuits to provide oil to the engine components at flow rates and/or pressures more closely tailored to the needs of the components within any given oil circuit.

Further areas of applicability of the present disclosure will become apparent from the detailed description, claims and drawings provided hereinafter. It should be understood that the summary and detailed description, including the disclosed embodiments and drawings, are merely exemplary in nature intended for purposes of illustration only and are not intended to limit the scope of the invention, its application or use. Thus, variations that do not depart from the gist of the disclosure are intended to be within the scope of the invention.

DETAILED DESCRIPTION

Figure 1:
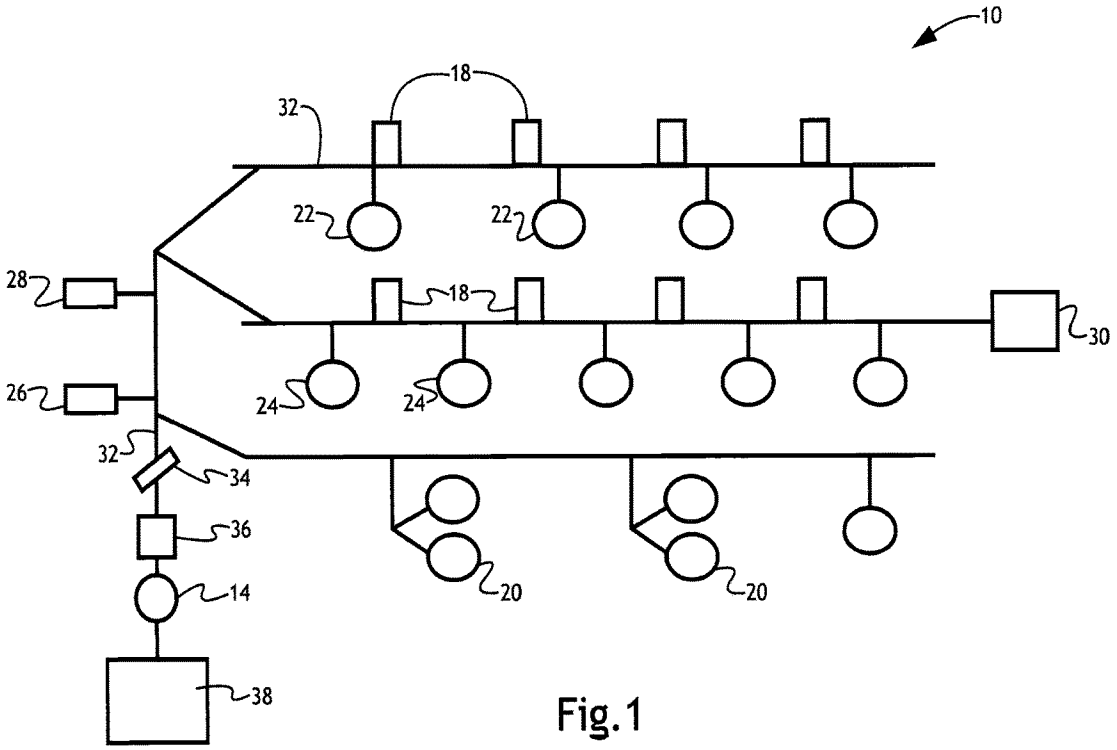
FIG. 1 is a schematic view of a first oil circuit for certain engine components.
Figure 2:
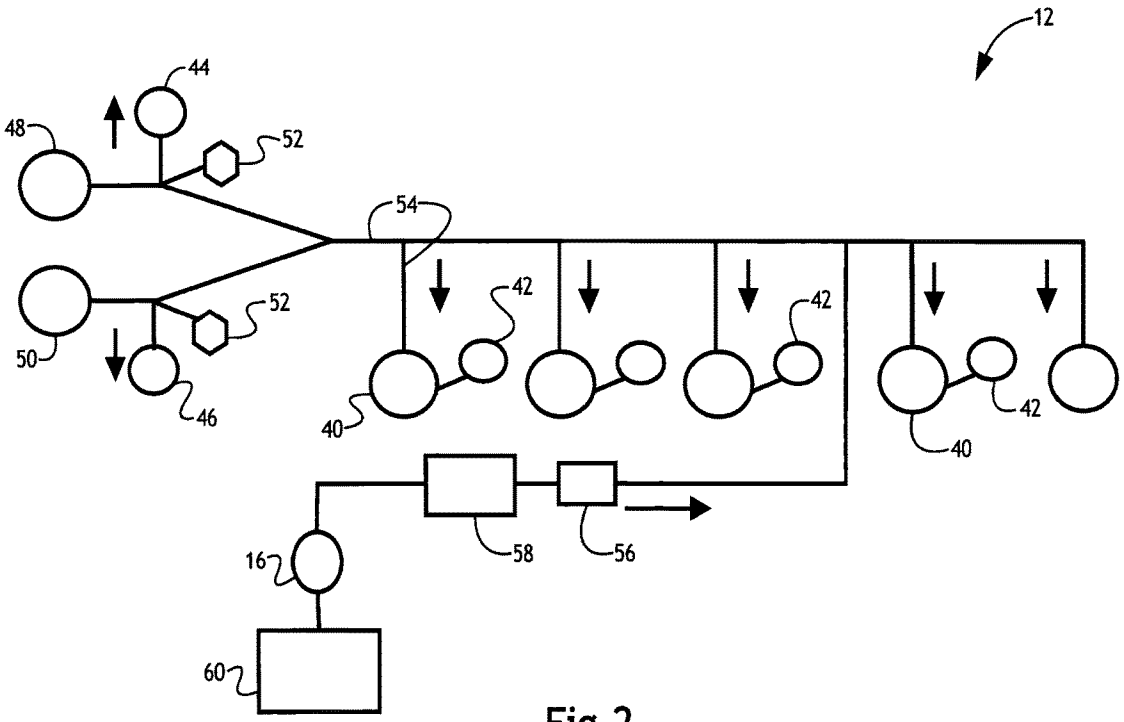
FIG. 2 is a schematic view of a second oil circuit for certain engine components different than the components associated with the first oil circuit.

Referring in more detail to the drawings, FIGS. 1 and 2 illustrate, in schematic form, an engine oil delivery system having two engine oil circuits 10, 12. The oil circuits 10, 12 provide oil flow to various engine components to lubricate and/or help control the temperature of the engine components. As used herein, an engine component is any component supplied oil by at least one of the oil circuits 10, 12. The oil may be provided from one or more reservoirs and each oil circuit may include one or more oil pumps that pump the oil through the circuits. In the implementation shown in FIGS. 1 and 2, a first oil circuit 10 (FIG. 1) includes a first oil pump 14, and a second oil circuit 12 (FIG. 2) includes a second oil pump 16. The second oil pump 16 may provide a different flow rate and/or pressure within the second circuit 12 than does the first oil pump 14 within the first oil circuit 10. In this way, components requiring similar oil pressure or flow rates may be grouped together in the first oil circuit 10, while components requiring a different pressure and/or flow rate may be grouped in the second oil circuit 12.

In more detail, the first oil circuit 10 may include various engine components such as, by way of examples without limitation, hydraulic lash adjusters 18, balance shaft bearings 20, intake cam bearings 22, exhaust cam bearings 24, timing drive tensioner 26, chain oiler 28, and a vacuum pump 30, and various passages and conduits 32 interconnecting the first oil pump 14 with these components. The first oil circuit 10 may also include other components like an oil cooler 34 (heat exchanger), an oil filter 36 and an oil source 38 (e.g. a reservoir). These components may all require or be suitable for use with an oil pump 14 that provides a low pressure but relatively high flow rate of oil within the first oil circuit 10.

The second oil circuit 12 may include engine components such as, by way of examples without limitation, main engine bearings 40, rod bearings 42, intake cam bearing 44, exhaust cam bearing 46, intake cam phaser 48, exhaust cam phaser 50 and oil control valve for the cam phaser mechanism 52, and various passages and conduits 54 interconnecting the second oil pump 16 with these components. The second oil circuit 12 may also include other components like an oil cooler 56, oil filter 58 and an oil source 60. The oil source 60 may be the same as or different than the oil source 38 for the first oil circuit 10.

In at least one implementation, the second oil circuit 12 may be completely independent of the first oil circuit 10. That is, other than the oil source, the components of the second oil circuit 12 may be segregated from and not in fluid communication with the components of the first oil source 10. Of course, in certain implementations, even the oil source 60 of the second oil circuit 12 may be different and independent from the oil source 38 of the first oil circuit 10.

It is also possible that certain components may be shared by the two oil circuits 10, 12. For example, a single oil cooler may receive oil from both circuits 10, 12. The oil flow from the circuits 10, 12 could be commingled within the oil cooler, the two circuits could share a sump, and/or they could share a common oil pick-up tube. Or the oil flows could be maintained separate within the oil cooler such that a single oil cooler provides two separate flow paths for oil therethrough, one for the first oil circuit 10 and one for the second oil circuit 12. Other components may likewise provide for shared or separate oil flow. In at least certain implementations, each oil circuit may include at least one engine component that is not in fluid communication with any other oil circuit.

By providing two oil circuits 10, 12 and two oil pumps 14, 16, different oil pressures and flow rates can be provided to the engine components of each circuit so that the oil delivery to at least certain engine components may be closer to the actual needs of those components than in conventional systems where all components receive oil from a single circuit. In a conventional oil circuit, where all components receive oil from the same circuit, the minimum flow rate is dictated by the engine component that requires the highest flow rate. Likewise, in a conventional oil circuit, the oil pressure is dictated by the component that requires the highest pressure. Accordingly, the hydraulic power in a conventional oil circuit is relatively high, where the power is proportional to the flow rate (which is higher than many components need) times the pressure (which also is higher than many components need).

Figure 3:
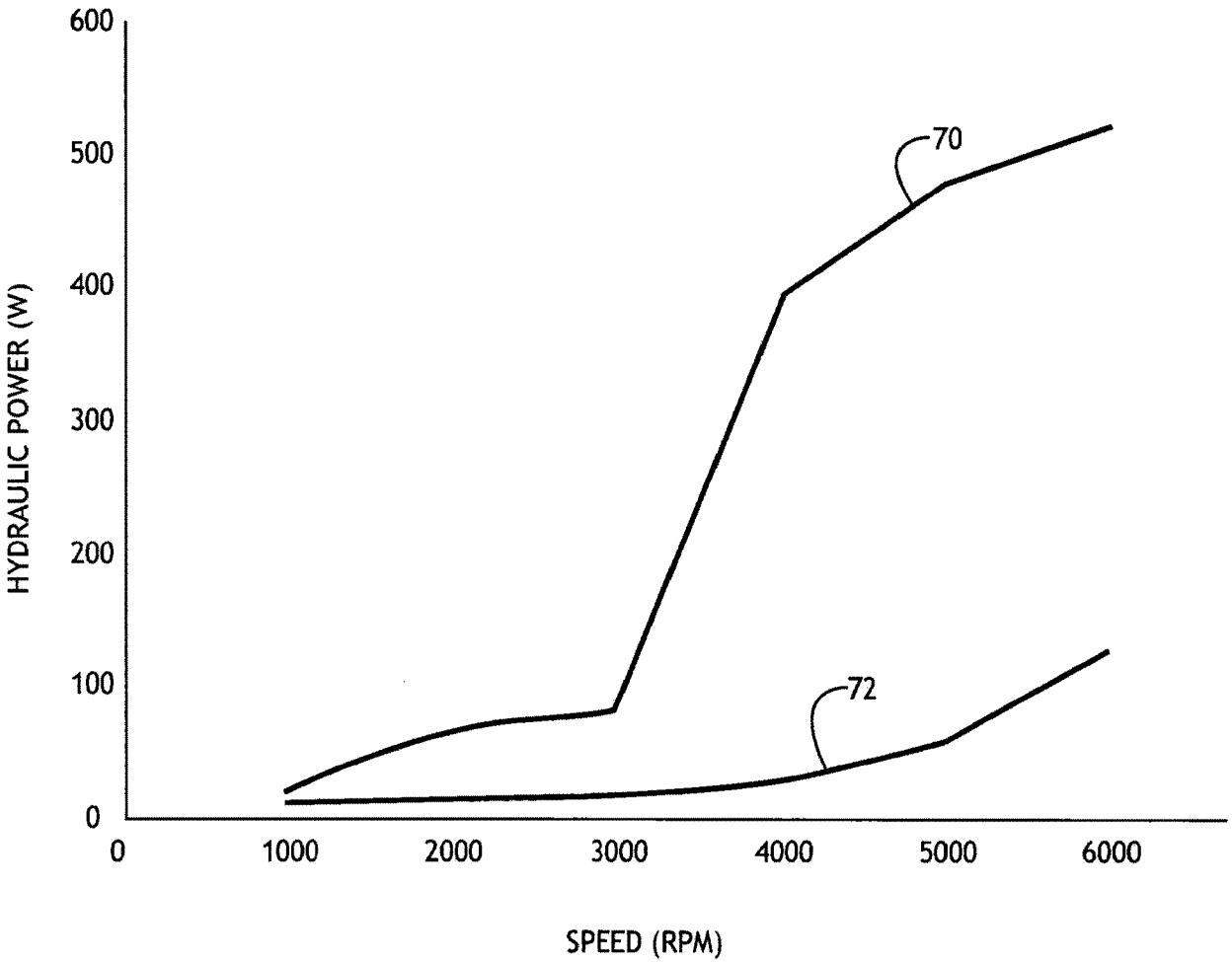
FIG. 3 is a graph comparing horsepower requirements for different oil circuit configurations.

With the different oil circuits 10, 12 as disclosed herein, the hydraulic power of the first circuit 10 plus the hydraulic power of the second circuit 12 is less than the hydraulic power that would be required if all engine components where fed by a single circuit. This is because the flow rate and/or pressure of oil delivered to at least some of the engine components is lower in the segregated oil circuits 10, 12 than they would be in a single oil circuit. This saves energy and lowers the hydraulic power required in the system as a whole. FIG. 3 illustrates a comparison of the power requirements (noted in watts) of a conventional single circuit oil system, shown as line 70, and a segregated, two circuit system as described herein. The combined hydraulic power of the two segregated oil circuits is shown by line 72. Accordingly, at 6,000 rpm, the hydraulic power required by the conventional circuit is about 520 watts while combined hydraulic power required by the segregated oil circuits is about 120 watts. Thus, a savings of about 400 watts is demonstrated which will lead to improved engine performance and/or improved fuel economy.

While illustrated with a separate oil pump 14, 16 for each of the oil circuits 10, 12, the oil pump may be a shared component wherein one motor drives two pumping elements and where each pumping element provides oil under pressure to a different one of the oil circuits (e.g. the motor may provide two output flows). In such a case, each pumping element may be considered a separate pump. Further, while two separate oil circuits are shown and described in detail, more than two oil circuits may be provided which may enable further refinement of the oil pressure and/or flow rate delivered to certain engine components.

To further illustrate this point, the first oil circuit 10 may provide oil at a flow rate of between about 10-15 liters/min or more and the second oil circuit 12 may provide an oil flow rate of up to 25-30 liters/hour. A ratio of the flow rates of the two oil circuits 10, 12 may be between about 2 to 3. The first oil circuit 10 may provide oil at a pressure of about 30-40 psi, and the second oil circuit 12 may provide oil at a pressure of about 35-50 psi or higher. A ratio of the pressures of the two oil circuits may be between about 1.2 to 1.3. Of course, other flow rates and pressures are possible, the above numbers being merely illustrative. Further, either the flow rate or the pressure may be the same among the oil circuits 10, 12 while the other flow characteristic is different. This would also provide a reduced hydraulic power in one of the circuits compared to the other. As such, the above noted ratios may be as low as 1.0 for one of the noted oil flow characteristics (pressure or flow rate).

What is claimed is:

1. An engine oil circuit for a vehicle, comprising:

a first oil circuit communicating with at least two first engine components;

a first oil pump communicating with the first oil circuit to supply fluid flow in the first oil circuit at a first flow rate and a first pressure;

a second oil circuit communicating with at least two second engine components, and wherein the second oil circuit is segregated from the first oil circuit; and a second oil pump communicating with the second oil circuit to supply fluid flow in the second oil circuit at the same time that the first oil pump provides fluid flow in the first oil circuit and at a second flow rate and a second pressure where at least one of the second flow rate or the second pressure is different than the first flow rate or the first pressure.

2. The circuit of claim 1 wherein the first flow rate is greater than the second flow rate.

3. The circuit of claim 2 wherein the first pressure is lower than the second pressure.

4. The circuit of claim 1 wherein a ratio of the first pressure to the second pressure is between 1.2 and 1.3.

5. The circuit of claim 1 wherein a ratio of the first flow rate to the second flow rate is between 2.0 and 2.5.

6. The circuit of claim 1 wherein said at least one first component uses a higher pressure and lower flow rate than said at least one second component.

7. The circuit of claim 1 wherein the first oil pump provides oil at a different hydraulic power than the second oil pump.

8. The circuit of claim 1 wherein said at least two first engine components includes at least one of two or more of the following types of engine components: a hydraulic lash adjuster; a balance shaft bearing; an intake cam bearing; an exhaust cam bearing; a timing drive tensioner; a chain oiler; or a vacuum pump, and said at least two second engine components includes at least one of two or more of the following types of engine components: a main engine bearing; a rod bearing; an intake cam bearing; an exhaust cam bearing; an intake cam phaser; an exhaust cam phaser; or an oil control valve for the cam phaser mechanism.

9. The circuit of claim 1 wherein said at least two first engine components includes two first engine components that are not used for spray cooling of an engine piston.

10. The circuit of claim 9 wherein said at least two second engine components includes two second engine components that are not used for spray cooling of an engine piston.

11. The circuit of claim 1 wherein said at least two first engine components includes at least one of two or more of the following types of engine components: a hydraulic lash adjuster; a balance shaft bearing; an intake cam bearing; an exhaust cam bearing; a timing drive tensioner; a chain oiler; or a vacuum pump, and said at least two second engine components includes two second engine components that are not used for spray cooling of an engine piston.

12. An engine oil circuit for a vehicle, comprising:

at least two oil circuits, each oil circuit separately communicating with at least two engine components that are not communicating with any other oil circuit;

at least two oil pumps with at least one oil pump provided for each oil circuit and where at least one of said oil pumps provides oil to its respective engine components at a flow rate or pressure that is different than at least one other oil pump.

13. The circuit of claim 12 wherein said at least one oil pump provides oil to its respective engine components at a flow rate or a pressure that is different than at least one other oil pump.

14. The circuit of claim 12 wherein each oil circuit operates at a different hydraulic power than the other oil circuits.

15. The circuit of claim 12 wherein at least one oil circuit is completely independent of every other oil circuit.

* * * * *